US009376652B2

(12) United States Patent
Nishina et al.

(10) Patent No.: US 9,376,652 B2
(45) Date of Patent: Jun. 28, 2016

(54) SOLID SOAP

(71) Applicant: P & PF CO., LTD., Osaka (JP)

(72) Inventors: Tetsuo Nishina, Osaka (JP); Takahito Makita, Osaka (JP); Tomoko Toda, Osaka (JP); Uhei Tamura, Osaka (JP)

(73) Assignee: P & PF Co., LTD., Osaka (JP)

( * ) Notice: Subject to any disclaimer, the term of this patent is extended or adjusted under 35 U.S.C. 154(b) by 0 days.

(21) Appl. No.: 14/668,123

(22) Filed: Mar. 25, 2015

(65) Prior Publication Data

US 2015/0275150 A1 Oct. 1, 2015

(30) Foreign Application Priority Data

Mar. 26, 2014 (JP) ..... 2014-062915

(51) Int. Cl.
*C11D 9/26* (2006.01)
*C11D 9/22* (2006.01)

(52) U.S. Cl.
CPC . *C11D 9/225* (2013.01); *C11D 9/26* (2013.01)

(58) Field of Classification Search
None
See application file for complete search history.

(56) References Cited

U.S. PATENT DOCUMENTS

| | | | |
|---|---|---|---|
| 4,169,067 | A | 9/1979 | Joshi |
| 4,874,538 | A | 10/1989 | Dawson |
| 6,906,018 | B1 | 6/2005 | Patel |
| 2008/0020959 | A1 | 1/2008 | Zhang |

FOREIGN PATENT DOCUMENTS

| | | | |
|---|---|---|---|
| EP | 0222525 | A2 | 5/1987 |
| JP | 2703826 | B2 | 1/1998 |
| JP | 2859106 | | 2/1999 |
| JP | 2859106 | B2 | 2/1999 |
| JP | 2003113073 | A2 | 4/2003 |
| JP | 2007146030 | A2 | 6/2007 |
| JP | 2008031162 | A2 | 2/2008 |
| JP | 2008031423 | A2 | 2/2008 |
| JP | 2008031468 | A2 | 2/2008 |
| JP | 2010006744 | A2 | 1/2010 |
| JP | 2011195690 | A2 | 10/2011 |
| JP | 2013155132 | A2 | 8/2013 |
| WO | 2007146027 | A1 | 12/2007 |
| WO | 2010092814 | A1 | 8/2010 |
| WO | 2011080101 | A1 | 7/2011 |

OTHER PUBLICATIONS

Extended European Search Report dated Jul. 21, 2015 issued in the corresponding European patent application No. 15158758.01.

*Primary Examiner* — Necholus Ogden, Jr.
(74) *Attorney, Agent, or Firm* — Rankin, Hill & Clark LLP

(57) ABSTRACT

[Problem] The problem to be solved by the present invention is to improve the foam properties of fatty acid soap.
[Means of solving] A solid soap comprising 20 to 70 mass % of fatty acid soaps, wherein the solid soap comprises dimethyldiallylammonium chloride/acrylamide polymer and a high-molecular polyethylene glycol.

2 Claims, No Drawings

SOLID SOAP

TECHNICAL FIELD

The present invention relates to a solid soap, and in particular, relates to the improvement of the foam properties of a solid soap wherein fatty acid soaps are the main components.

BACKGROUND ART

When a solid fatty acid soap, wherein the sodium salts of fatty acids are the main base, is used for facial cleansing or bathing, not only its adequate cleansing property but also foaming and the feeling in use are very important evaluation elements.

In particular, problems in foaming and foam properties may arise in high design-quality transparent soap.

That is, the structural mechanism of solid transparent soap being transparent is considered that opaque solid-soap fibrous microcrystals, which are optically discontinuous in size with respect to visible light, are mainly severed perpendicularly to the fiber axes by the addition of sugars and polyols and fined to the size of wavelengths of visible light or less; as a result the soap becomes transparent (Patent Literature 1).

When a large amount of polyols is added as the crystallization inhibitor for fatty acid salt, the amount of added polyols may be as high as several tens of % with respect to the total amount of soap. As a result the percentage of fatty acid salts may decrease, and the foaming property and foam properties may deteriorate.

Thus, the improvement in foaming property and foam properties is very important problem especially in the field of facial cleansing soap.

PRIOR ART DOCUMENT

Patent Literatures

[Patent Literature 1] Japanese Patent Publication No. 2859106

SUMMARY OF THE INVENTION

Problem to be Solved By the Invention

The present invention was made in view of the above-described conventional art, and the problem to be solved is to improve the foaming property and foam properties of fatty acid soap, and in particular, those of solid transparent soap.

Means to Solve the Problem

In order to achieve the above-described object, the present inventors have investigated the effect of water-soluble polymers on fatty acid soap. As a result, the present inventors have found, that foam properties are drastically improved by blending a specific cationic polymer and a high-molecular polyethylene glycol, thus leading to the completion of the present invention.

The present invention, to solve the above-described problem, is characterized by comprising dimethyldiallylammonium chloride/acrylamine polymer and a high-molecular polyethylene glycol in the solid soap wherein fatty acid soaps are the main component.

It is preferable that the above-described solid soap is a solid transparent soap that further comprises 30 to 70 mass % of sugar/polyol part.

In the above-described solid soap, it is preferable that the blending quantity of the above-described dimethyldiallylammonium chloride/acrylamide polymer is 0.15 to 1.0 mass % with respect to the total amount.

In the above-described solid soap, it is also preferable that the molecular weight of a high-molecular polyethylene glycol is 4 million to 8 million and the blending quantity is 0.0005 to 0.002 mass % with respect to the total amount of solid soap.

Hereinafter, the constitution of the present invention will be described in detail.

[Fatty Acid Soaps Part]

The fatty acids used in the soap of the present invention are saturated or unsaturated fatty acids wherein the number of carbon atoms is preferably 8 to 20 and more preferably 12 to 18, and it may be either linear or branched. Specific examples include lauric acid, myristic acid, palmitic acid, stearic acid, oleic acid, isostearic acid, and mixtures thereof namely beef tallow fatty acid, palm oil fatty acid, coconut oil fatty acid, and palm kernel oil fatty acid.

As the counter ion that forms fatty acid alkali metal salt, sodium or potassium is preferable. In addition, some of the fatty acids can form an ion pair with the below-described alkanolamine.

Specific examples of the fatty acid sodium/potassium mixed salt include sodium/potassium laurate, sodium/potassium myristate, sodium/potassium palmitate, sodium/potassium stearate, sodium/potassium oleate, sodium/potassium isostearate, beef tallow fatty acid sodium/potassium salt, palm oil fatty acid sodium/potassium salt, coconut oil fatty acid sodium/potassium salt, and palm kernel oil fatty acid sodium/potassium salt, and these may be used either alone or in combination of two or more. Among the above-described fatty acid sodium/potassium mixed salts, sodium/potassium laurate, sodium/potassium myristate, sodium/potassium palmitate, sodium/potassium stearate, sodium/potassium oleate, and sodium/potassium isostearate can be preferably used.

It is preferable that the content of fatty acid soaps in the soap of the present invention is 20 to 70 mass %. If the content is less than 20 mass %, the solidifying point decreases; as a result, the surface may melt when stored for a long period of time. In addition, the transparency may decrease in the transparent solid soap; as a result, the commercial value may be lost, and the cleansing power is also insufficient. On the contrary, if the content exceeds 70 mass %, the transparency may decrease in the transparent soap and a taut feeling may be generated after use.

When the alkali metal salts of fatty acids are sodium/potassium mixed salts, the mole percentage of potassium as the counter ion in fatty acid soap is preferably 0 to 20 mole % and especially preferably 0 to 10 mole %. If the mole percentage of potassium exceeds 20 mole %, the satisfactory solidifying point cannot be obtained. When stored for a long period of time, the surface may melt and the commercial value may be lost. In addition, the hardness may decrease, the soap reduction through dissolution during use may become large, soap sweating may be caused under the conditions of high temperature and high humidity, and the surface may become cloudy during use.

In the present invention, alkanolamine can also be used as the counter ion of fatty acid. As the alkanolamine used suitably in the present invention, triethanolamine, diethanolamine, and monoethanolamine can be listed, and in particular, triethanolamine is preferable from the viewpoint of stability.

The blending quantity of an alkanolamine is 1 to 30 mole % with respect to the fatty acid and especially preferably 1 to 10 mole %. If the blending quantity exceeds 30 mole %, the melting point, hardness, and the solubility by rubbing tend to deteriorate. If the blending quantity is less than 1 mole %, the effect of alkanolamine may not be satisfactorily achieved.

Alkanolamine may form salt with fatty acid or may not form salt.

[Sugar/polyol Parts]

Preferable sugar/polyol examples, when the present invention is used for transparent solid soap, include maltitol, sorbitol, glycerin, 1,3-butylene glycol, propylene glycol, polyethylene glycol, sugar, pyrrolidone carboxylic acid, sodium pyrrolidine carboxylate, hyaluronic acid, and polyoxyethylene alkyl glucoside ether, and it is preferable to blend 30 to 70 mass % thereof in the composition.

In particular, to obtain transparency as well as excellent usability, the ratio of the sugar/sugar alcohol and the polyol is preferably 40 to 60:60 to 40 in the sugar/polyol part.

[Amphoteric Surfactants]

It is preferable that the solid soap of the present invention comprises the following amphoteric surfactant.

As the amphoteric surfactant usable in the solid soap of the present invention, amphoteric surfactants represented by the following chemical formulas (A) to (C) can be listed.

[Chemical formula 1]

(A)

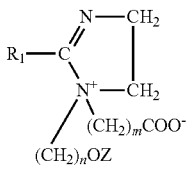

[In the formula, $R_1$ represents an alkyl group or an alkenyl group of 7 to 21 carbon atoms, n and m are the same or different from each other and represent an integer of 1 to 3, and Z represents a hydrogen atom or $(CH_2)_pCOOY$ (here, p is an integer of 1 to 3, and Y is an alkali metal, an alkaline earth metal, or an organic amine),],

[Chemical formula 2]

(B)

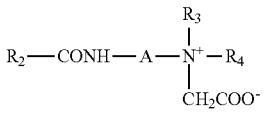

[In the formula, $R_2$ represents an alkyl group or an alkenyl group of 7 to 21 carbon atoms, $R_3$ and $R_4$ are the same or different from each other and represents a lower alkyl group, and A represents a lower alkylene group.], and

[Chemical formula 3]

(C)

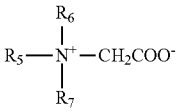

[In the formula, $R_5$ represents an alkyl group or an alkenyl group of 8 to 22 carbon atoms, $R_6$ and $R_7$ are the same or different from each other and represent a lower alkyl group.].

In chemical formula (A), "an alkyl group of 7 to 21 carbon atoms" represented by $R_1$ can be either linear or branched, and the number of carbon atoms is preferably 7 to 17. "An alkenyl group of 7 to 21 carbon atoms" represented by $R_1$ can be either linear or branched, and the number of carbon atoms is preferably 7 to 17. As "an alkali metal" represented by Y, sodium, potassium, etc. can be listed, as "an alkaline earth metal", calcium, magnesium, etc. can be listed, and as "an organic amine", monoethanolamine, diethanolamine, triethanolamine, etc. can be listed.

Specific examples of amphoteric surfactants represented by chemical formula (A) include imidazolinium betaine-type surfactants such as 2-undecyl-N-carboxymethyl-N-hydroxyethylimidazolium betaine (synthesized from lauric acid; hereinafter, for convenience, also referred to as "lauroyl imidazolinium betaine"), 2-heptadecyl-N-carboxymethyl-N-hydroxyethylimidazolium betaine (synthesized from stearic acid), and 2-alkyl or alkenyl-N-carboxymethyl-N-hydroxyethylimidazolium betaine synthesized from coconut oil fatty acid ($R_1$ is a mixture of $C_7$ to $C_{17}$; hereinafter, for convenience, also referred to as "cocoyl imidazolinium betaine").

In chemical formula (B), "an alkyl group of 7 to 21 carbon atoms" and "an alkenyl group of 7 to 21 carbon atoms" represented by $R_2$ are similar to those represented by $R_1$ in chemical formula (A). "A lower alkyl group" represented by $R_3$ and $R_4$ is linear or branched and preferably an alkyl group of 1 to 3 carbon atoms. "A lower alkylene group" represented by A is linear or branched and preferably an alkylene group of 3 to 5 carbon atoms.

Specific examples of amphoteric surfactants represented by chemical formula (B) (amidoalkyl betaine-type) include amidopropyl betaine-type surfactants such as coconut oil fatty acid amidopropyldimethylaminoacetic acid betaine ($R_2$ is a mixture of $C_7$ to $C_{17}$).

In chemical formula (C), "an alkyl group of 8 to 22 carbon atoms" represented by $R_5$ can be either linear or branched, and the number of carbon atoms is preferably 8 to 18. "An alkenyl group of 8 to 22 carbon atoms" represented by $R_5$ can be either linear or branched, and the number of carbon atoms is preferably 8 to 18. "A lower alkyl group" represented by $R_6$ and $R_7$ is similar to the one represented by $R_3$ and $R_4$ in chemical formula (B).

Specific examples of amphoteric surfactants (alkyl betaine-type) represented by chemical formula (C) include lauryldimethylaminoacetic acid betaine and alkyl or alkenyldimethylaminoacetic acid betaine ($R_5$ is a mixture of $C_5$ to $C_{18}$) synthesized from coconut oil fatty acid.

In the present invention, at least one surfactant is selected for use from the group consisting of amphoteric surfactants represented by the above-described chemical formulas (A) to (C).

In the solid soap of the present invention, when the above-described amphoteric surfactant is blended, the fatty acid soap (fatty acid sodium salt or fatty acid sodium/potassium mixed salt) and the amphoteric surfactant form a composite salt. Thus, the usability such as "a frictional feeling" is improved and the hardness is also improved; as a result, the soap reduction through dissolution can be lowered.

In the solid soap of the present invention, the content of the above-described amphoteric surfactant is preferably 1 to 15 mass %, and especially preferably 4 to 8 mass %. If this content is less than 1 mass %, the solidifying point becomes low. Thus, when stored for a long period of time, the surface may melt and the commercial value may be lost. In addition, the hardness may decrease, and the weight loss of the soap through dissolution during use may become large. In addition, the transparency may decrease. On the contrary, if the content exceeds 15 mass %, a sticky feeling is generated after use. In addition, when stored for a long period of time, the surface changes to brown and the commercial value may be lost.

[Nonionic Surfactants]

It is preferable to further blend a nonionic surfactant to the solid soap of the present invention. Examples of usable nonionic surfactants include polyoxyethylene (hereinafter also referred to as "POE") hydrogenated castor oil, polyoxyethylene 2-octyldodecyl ether, polyoxyethylene lauryl ether, propylene oxide/ethylene oxide copolymer, polyoxyethylene polyoxypropylene cetyl ether, polyoxyethylene polyoxypropylene glycol, polyethylene glycol diisostearate, alkyl glucosides, polyoxyethylene-modified silicones (for example, polyoxyethylene alkyl-modified dimethylsilicones), polyoxyethylene-glycerin monostearate, polyoxyethylene alkyl glycosides, alkanolamides, and polyoxyethylene alkanolamides. These may be used either alone or in combination of two or more. Among the above-described nonionic surfactants, polyoxyethylene hydrogenated castor oil is used preferably.

In the solid soap of the present invention, a more improving effect in usability can be achieved by blending a nonionic surfactant.

The content of a nonionic surfactant in the solid soap of the present invention is preferably 1 to 15 mass %, and especially preferably 6 to 1.2 mass %. If this content is less than 1 mass %, a taut feeling may be generated after use. On the contrary, if the content exceeds 15 mass %, the solidifying point decreases. Thus, when stored for a long period of time, the surface may melt and the commercial value maybe lost. In addition, the hardness may decrease, and the weight loss of the soap through dissolution during use may become large. In addition, a sticky feeling may be generated after use.

[Hydroxyalkyl Ether Carboxylic Acid Salt-type Surfactants]

It is preferable to add a hydroxyalkyl ether carboxylic acid salt-type surfactant to the solid soap of the present invention; then the improvement in foaming can be observed.

The preferable hydroxyalkyl ether carboxylic acid salt-type surfactant, in the present invention, has the following structure (D).

[Chemical formula 4]

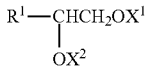

(D)

(In the formula, $R^1$ represents a saturated or unsaturated hydrocarbon group of 4 to 34 carbon atoms; either one of $X^1$ and $X^2$ represents $—CH_2COOM^1$, and the other one represents a hydrogen atom; and $M^1$ represents a hydrogen atom, an alkali metal, an alkaline earth metal, ammonium, a lower alkanolamine cation, a lower alkyl-amine cation, or a basic amino acid cation.)

In the formula, $R^1$ is either an aromatic hydrocarbon or a linear or branched aliphatic hydrocarbon; however, an aliphatic hydrocarbon, especially an alkyl group or an alkenyl group is preferable. Preferable examples include a butyl group, an octyl group, a decyl group, a dodecyl group, a tetradecyl group, a hexadecyl group, an octadecyl group, a docosyl group, a 2-ethylhexyl group, a 2-hexyldecyl group, a 2-octylundecyl group, a 2-decyltetradecyl group, a 2-undecylhexadecyl group, a decenyl group, a dodecenyl group, a tetradecenyl group, and a hexadecenyl group. Among them, a decyl group and a dodecyl group have advantage in the surface-active power.

In the formula, either one of $X^1$ and $X^2$ is represented by $—CH_2COOM^1$, and the examples of $M^1$ include a hydrogen atom, lithium, potassium, sodium, calcium, magnesium, ammonium, monoethanolamine, diethanolamine, triethanolamine, etc.

Specifically, among the above-described (D) hydroxyalkyl ether carboxylic acid salt-type surfactants, sodium dodecane-1,2-diol acetate ether, in which H of either of the OH groups of dodecane-1,2-diol is replaced with —$CH_2COONa$, is most preferable in the present invention.

In the present invention, 1 to 15 mass % and preferably 5 to 10 mass % of a hydroxyalkyl ether carboxylic acid salt-type surfactant can be blended from the viewpoint of the improvement of foaming.

In the present invention, the following components can be optionally blended as additives other than the above-described components as long as the above-described effect is not impaired. These optional components are disinfectants such as trichlorocarbanilide and hinokitiol; medicinal agents such as trimethylglycine; oil; perfume; coloring matter; chelating agents such as trisodium edetate dihydrate; UV absorbers; antioxidants; natural extracts such as dipotassium glycyrrhizinate, plantago herb extract, lecithin, saponin, aloe, phellodendron bark, and chamomile; nonionic, cationic or anionic water-soluble polymers; opacifying agents such as titanium oxide; usability improvers such as lactic acid esters; etc.

As a chelating agent which is used in the cleansing composition of the present invention, hydroxyethane diphosphonic acid and salts thereof are preferably used, and more preferably hydroxyethane diphosphonic acid is used. The blending quantity is preferably 0.001 to 1.0 mass %, and more preferably 0.1 to 0.5 mass %. If the blending quantity of hydroxyethane diphosphonic acid and salts thereof is less than 0.001 mass %, some disadvantageous events appear as the following. The chelating effect is insufficient, and unfavorable yellow discoloration, takes place with time, etc. If the blending quantity is higher than 1.0 mass %, strong irritation to the skin is caused and it is undesirable.

As the production method of the soap of the present invention, the general methods such as the framing method and milling method can be applied to the mixture of the above-described components.

If the solid soap of the present invention is a transparent solid soap, the soap with decreased transparency due to blended pigment etc. is also included in the transparent solid soap.

EFFECT OF THE INVENTION

As explained above, according to the solid soap of the present invention, the marked improvement in foam properties can be achieved by adding a specific polymer to the solid transparent soap wherein fatty acid alkali metal salts are the main component.

BEST MODES FOR CARRYING OUT THE INVENTION

Hereinafter, the preferred embodiment of the present invention will be explained.

In the following test, the bubbles foamed with a mixer were placed into a petri dish and the bubble compressive stress was measured two times with a rheometer (adapter: 40 mmϕ, load: 200 g); the bubble hardness was evaluated based on the average value.

The bubble distribution was determined by placing the bubbles that were foamed with a mixer into a transparent cell, whose cross-sectional area is 1 cm×1 cm, and measuring the number of bubbles in 0.552 $mm^2$ and the size of bubbles, three times, with a microscope.

The average size of bubbles was determined based on these measurement values.

The sensory evaluation of foam properties was conducted by six professional usability evaluation panelists. They rated the foam comfort, with the following five levels, by focusing on foam smoothness and the spreadability upon application. The evaluation was based on the rounded average score of six panelists, ○○ good: 2 points, ○ somewhat good: 1 point, Δ average: 0 points, x somewhat poor: −1 point, X X poor; −2 points Other evaluations were carried out according to the conventional methods.

Initially, the present inventors have investigated the improvement of foam properties by the addition of various polymers to the fatty acid soap of the basic formulation.

The basic formulation is shown in Table 1

TABLE 1

| | Contents (mass %) |
|---|---|
| lauric acid | 5 |
| myristic acid | 10 |
| palmitic acid | 3 |
| stearic acid | 5 |
| isostearic acid | 2.5 |
| sodium hydroxide | 3.5 |
| potassiam hydroxide | 1.5 |
| sodium dodecane-1,2-diol acetate ether | 3 |
| sodium N-lauroyl-N'-carboxymethyl-N'-hydroxyethylethylenediamine | 2 |
| PEG-60 hydrogenated castor oil | 5 |
| polyoxypropyleneglycerylether | 5 |
| concentrated glycerin | 10 |
| sucrose | 10 |
| sorbitol | 5 |
| ion-exchanged water | balance |

Various polymers were added to the above-described basic formulation, and the improvement effect on the foam properties was evaluated. The results are shown in Table 2.

The content of cationic polymer (mass %) in each polyquaternium is as follows: about 40% in the case of polyquaternium-6, 100% in the case of polyquaternium-7, about 40% in the case of polyquaternium-22, and about 10% in the case of polyquaternium-39; however, the respective solid quantities are shown in the table.

TABLE 2

Added amounts of polymers are shown in mass %

| | Test Examples | | | | | | | | | | |
|---|---|---|---|---|---|---|---|---|---|---|---|
| | 1-1 | 1-2 | 1-3 | 1-4 | 1-5 | 1-6 | 1-7 | 1-8 | 1-9 | 1-10 | 1-11 |
| polyquaternium-6 | — | 0.5 | | | | | | | 0.5 | | |
| polyquaternium-7 | — | | 0.5 | | | | | | | 0.5 | |
| polyquaternium-22 | — | | | 0.5 | | | | | | | 0.5 |
| polyquaternium-39 | — | | | | 0.5 | | | | | | |
| polyethyleneglycol | — | | | | | | | | | | |
| MW 600,000 | — | | | | | 0.001 | | | 0.001 | | |
| MW 4,000,000 | — | | | | | | 0.001 | | | 0.001 | |
| MW 8,0000,000 | — | | | | | | | 0.001 | | | 0.001 |
| sensory evaluation | x | Δ | Δ | Δ | Δ | Δ | Δ | Δ | Δ | ○ | Δ |

| | Test Examples | | |
|---|---|---|---|
| | 1-12 | 1-13 | 1-14 |
| polyquaternium-6 | | 0.5 | |
| polyquaternium-7 | | | 0.5 |
| polyquaternium-22 | | | |
| polyquaternium-39 | 0.5 | | |
| polyethyleneglyeol | | | |
| MW 600,000 | 0.001 | | 0.001 |
| MW 4,000,000 | | 1.001 | |
| MW 8,0000,000 | | | |
| sensory evaluation | Δ | Δ | Δ |

As is clear from Table 2, some improvement effect on the foam properties was observed, by the addition of a cationic polymer or a high-molecular polyethylene glycol, compared with that of the control (Test Example 1-1); however, use of one of the two types of polymers could not give sufficient effect (Test Examples 1-2 to 1-8).

Even when a cationic polymer and a high-molecular polyethylene glycol were used in combination, the evaluation was not different, in many cases, from that in the cases using one of them. However, in Test Example 1-10, wherein polyquaternium-7 (dimethyldiallylammonium chloride/acrylamide polymer: Merquat 2200) and a high-molecular polyethylene glycol were used in combination, the prominent improvement effect on the foam properties was observed.

Therefore, the present inventors investigated in detail the effects of some combinations of polyquaternium-7 and various high-molecular polyethylene glycols. The results are shown in Table 3.

TABLE 3

Added amounts of polymers are shown in mass %.

| | Test Examples | | | |
|---|---|---|---|---|
| | 2-1 | 2-2 | 2-3 | 2-4 |
| polyquaternium-7 | 0.75 | 0.75 | 0.75 | 0.75 |
| polyethyleneglycol | | | | |
| Mw 600,000 | 0 | 0.0015 | 0 | 0 |
| Mw 4,000,000 | 0 | 0 | 0.0015 | 0 |
| Mw 8,000,000 | 0 | 0 | 0 | 0.0015 |
| bubble hardness | 14 | 15 | 15.5 | 13 |
| distribution of bubbles | | | | |
| 121 μm or more | 0 | 0 | 0 | 0 |
| 81 to 120 μm | 8 | 5 | 1 | 4 |

TABLE 3-continued

Added amounts of polymers are shown in mass %.

| | Test Examples | | | |
|---|---|---|---|---|
| | 2-1 | 2-2 | 2-3 | 2-4 |
| 41 to 80 μm | 25 | 28 | 15 | 21 |
| 40 μm or less | 67 | 67 | 84 | 75 |
| average of sizes of bubbles | 43 | 42 | 35 | 39 |
| sensory evaluation of foam properties | Δ | Δ | ○○ | ○○ |
| solidifying point | 46 | 50 | 51 | 50 |

The feeling in use was evaluated by the sensory evaluation of foam properties. According to Table 3, the synergistic improvement effect on the foam properties was small in the combination of polyquaternium-7 and the high-molecular polyethylene glycol with the molecular weight of 600 thousand. In the combination of polyquaternium-7 and the high-molecular polyethylene glycol with the molecular weight of 4 million to 8 million, the marked synergistic improvement effect on the foam properties was observed. In particular, when the high-molecular polyethylene glycol with the molecular weight of 4 million was used, an increase in the bubble hardness and the finer bubbles were observed and a good feeling in use was present, thus the best foam properties were obtained.

What is more noteworthy is an increase in the solidifying point. Normally, for the improvement of the foam volume of fatty acid soap, potassium or triethanolamine can be used as the counter ion of fatty acid. In this case, however, the solidifying point decreases, leading to the lowering of the workability during soap production, and the hardness decreases. In addition, weight of soap is easily lost by dissolution; thus the basic properties of solid soap tend to deteriorate. In the present invention, however, the foam properties have significantly improved, whereas an increase in the solidifying point was observed; thus there is no effect on the working characteristics during production.

The present inventors also investigated the preferable blending quantity of polyquaternium-7 and that of high-molecular polyethylene glycol. The results are shown in Table 4 and Table 5.

TABLE 4

Added amounts of polymers are shown in mass %.

| | Test examples | | | | |
|---|---|---|---|---|---|
| | 2-1 | 3-1 | 3-2 | 3-3 | 3-4 |
| polyquaternium-7 | 0.75 | 0.75 | 0.75 | 0.75 | 0.75 |
| polyethyleneglycol MW 4,000,000 | 0 | 0.0005 | 0.001 | 0.0015 | 0.002 |
| bubble hardness | 14 | 15 | 15 | 18 | 18 |
| distribution of bubbles | | | | | |
| 121 μm or more | 0 | 0 | 0 | 0 | 0 |
| 81 to 120 μm | 8 | 4 | 2 | 1 | 1 |
| 41 to 80 μm | 25 | 24 | 15 | 15 | 15 |
| 40 μm or less | 67 | 72 | 83 | 84 | 84 |
| average of sizes of bubbles | 43 | 40 | 36 | 35 | 35 |
| sensory evaluation of foam properties | Δ | ○ | ○○ | ○○ | ○○ |
| solidifying point | 46 | 50 | 51 | 51 | 50 |

From the results of the above Table 5, it is understood that the blending quantity of polyquaternium-7 is preferably 0.15 to 1.0 mass % and especially preferably 0.5 to 0.75 mass %.

In the above-described quantity range, the average size of bubbles was fined and the improvement in the feeling in use, which was evaluated by the sensory evaluation of the foam properties, was prominent (bubbles became hard, dense, and more smooth).

On the other hand, when the added amount of either of the polymers is less than the above-described ranges, the synergistic improvement effect on the foam properties was hardly observed. If an excess is added, a slimy feeling may be generated during use.

What is claimed is:

1. A solid soap comprising 20 to 70 mass % of fatty acid soaps, wherein the solid soap comprises dimethyldiallylammonium chloride/acrylamide polymer and a high-molecular polyethylene glycol of which molecular weight is 4 million to 8 million, wherein the blending quantity of the dimethyldiallylammonium chloride/acrylamide polymer is 0.15 to 1.0 mass % with respect to the total amount of the solid soap and the blending quantity of the high-molecular polyethylene glycol is 0.0005 to 0.002 mass % with respect to the total amount of the solid soap.

TABLE 5

Added amounts of polymers are shown in mass %

| | Test examples | | | | | | | |
|---|---|---|---|---|---|---|---|---|
| | 4-1 | 4-2 | 4-3 | 4-4 | 4-5 | 4-6 | 4-7 | 4-8 |
| polyquaternium-7 | 0 | 0.1 | 0.15 | 0.2 | 0.25 | 0.5 | 0.75 | 1.0 |
| polyethylene-glycol MW 4,000,000 | 0.0015 | 0.0015 | 0.0015 | 0.0015 | 0.0015 | 0.0015 | 0.0015 | 0.0015 |
| bubble hardness | 15 | 15 | 15 | 17 | 18 | 18 | 18 | 17 |
| distribution of bubbles | | | | | | | | |
| 121 μm or more | 0 | 0 | 0 | 0 | 0 | 0 | 0 | 0 |
| 81 to 120 μm | 7 | 5 | 4 | 4 | 3 | 1 | 1 | 0 |
| 41 to 80 μm | 35 | 33 | 32 | 30 | 27 | 16 | 15 | 16 |
| 40 μm or less | 58 | 62 | 64 | 66 | 70 | 83 | 84 | 84 |
| average of sizes of bubbles | 45 | 43 | 42 | 42 | 40 | 36 | 35 | 35 |
| sensory evaluation | Δ | Δ | ○ | ○ | ○ | ○○ | ○○ | ○ |
| solidifying point | 45 | 47 | 49 | 50 | 50 | 51 | 51 | 50 |

From the results of the above Table 4, the blending quantity of high-molecular polyethylene glycol is preferably 0.0005 to 0.002 and especially preferably 0.001 to 0.002 mass %.

2. The solid soap according to claim 1, wherein the solid soap is a solid transparent soap further comprising at least one selected from the group consisting of sugar and polyol.

* * * * *